US005680788A

United States Patent [19]

Kootte

[11] Patent Number: 5,680,788

[45] Date of Patent: Oct. 28, 1997

[54] POWER CRIMPING TOOL HAVING IMPROVED CRIMPING MECHANISM FOR TAPE FEED PRODUCTS

[75] Inventor: Eric Kootte, Harrisburg, Pa.

[73] Assignee: The Whitaker Corporation, Wilmington, Del.

[21] Appl. No.: 515,432

[22] Filed: Aug. 15, 1995

[51] Int. Cl.[6] ..... B21J 9/18

[52] U.S. Cl. ..... 72/452.8; 72/453.16

[58] Field of Search ..... 72/452.1, 452.8, 72/452.9, 453.15, 453.16, 409.09, 409.1

[56] References Cited

U.S. PATENT DOCUMENTS 5,509,194 4/1996 Hornung et al. ..... 72/452.8

*Primary Examiner*—Lowell A. Larson
*Assistant Examiner*—John Paradiso

[57] ABSTRACT

A powered hand tool (10) is disclosed for crimping terminals (30) onto a conductor. The tool includes a linear actuator (18) for driving a cam (64) along a linear path (272). The cam (64) has camming surfaces (90, 92) that interact with a pair of followers (192, 194) to first cause the crimping mechanism (16) to crimp the terminal and then, early in the return stroke, to open the crimping mechanism (16) so that the crimped terminal (30) can be removed and the next terminal fed into position during the remainder of the return stroke. The cam (64) includes two part camming surfaces (94, 96 and 98, 100), both parts of which are tracked by the followers (192, 194) while performing the crimping operation. Once the followers reach a certain point along the camming surfaces (90, 92) a gate member (68) moves one of the parts (96, 100) out of alignment so that upon the return stroke the followers (192, 194) return by a different path, thereby opening the crimping mechanism early in the return stroke.

17 Claims, 9 Drawing Sheets

POWER CRIMPING TOOL HAVING IMPROVED CRIMPING MECHANISM FOR TAPE FEED PRODUCTS

The present invention is related to powered hand tools for crimping terminals arranged on a tape onto electrical conductors, and more particularly to an improved crimping mechanism therefore.

BACKGROUND OF THE INVENTION

Powered hand tools for crimping terminals onto conductors are often bulky and relatively heavy, making them inconvenient and sometimes difficult to use. Because crimping tools must generate substantial forces to crimp a terminal, the tool must be correspondingly strong, which usually translates into substantial weight. Commonly, such tools utilize a wedge that is driven by an air cylinder between two rollers that are journaled on the ends of a pair of links. The other ends of the links have crimping tooling or dies mounted thereto. As the wedge moves between the rollers the two links pivot like a pair of pliers, causing the tooling to close and crimp a terminal. As the wedge is retracted to its starting position the crimping dies separate so that the crimped product can be removed and the operation repeated. Since the terminals are arranged on a strip of tape and automatically fed laterally into crimping position, the crimping dies must separate a sufficient amount to allow the terminal to pass through. The maximum separation of the crimping dies occurs when the two rollers are in mutual contact. To achieve sufficient separation the length of the wedge and the stroke of the air cylinder must be relatively long thereby resulting in a somewhat bulky and heavy hand tool.

What is needed is a powered hand tool that is relatively small and light in weight that has the capability to automatically feed terminals arranged on a strip of tape, and that can generate the required forces to effect a high quality crimp.

SUMMARY OF THE INVENTION

A powered hand tool is disclosed for crimping a tape fed terminal onto an electrical conductor. The tool includes a frame, a linear actuator having a piston rod arranged to move in a first direction and a second opposite direction along a longitudinal axis, and a terminal crimping mechanism. The terminal crimping mechanism includes a fixed crimping jaw attached to the frame, a cam attached to and carried by the piston rod, and an indent member pivotally attached to the frame. The cam has a camming surface composed of a first portion and a second portion, the second portion being movable with respect to the first portion. The indent member has a cam follower at one end thereof adapted for following engagement with the camming surface and a movable crimping jaw attached to another end thereof. The indent member is arranged so that when it is pivoted in one direction the movable crimping jaw moves toward the fixed crimping jaw. The first and second portions of the camming surface are arranged so that when a terminal is in crimping position between the crimping jaws and the follower is in a start position, as the piston rod is moved in the first direction the follower engages and follows along the second portion of the camming surface causing the indent member to pivot in the one direction into partial crimping engagement with the terminal. Then, while the piston rod continues to move in the first direction the follower engages and follows along the first portion of the camming surface causing the indent member to pivot further in the one direction into full crimping engagement with the terminal. Then, as the piston rod is moved in the second direction the follower follows along the first portion of the camming surface and then moves from the first portion to its starting position while being spaced from the second portion of the camming surface. While the follower is moving from the first portion of the camming surface to its start position the indent member is caused to pivot thereby moving the jaws apart.

DESCRIPTION OF THE PREFERRED EMBODIMENT

Figure 1:
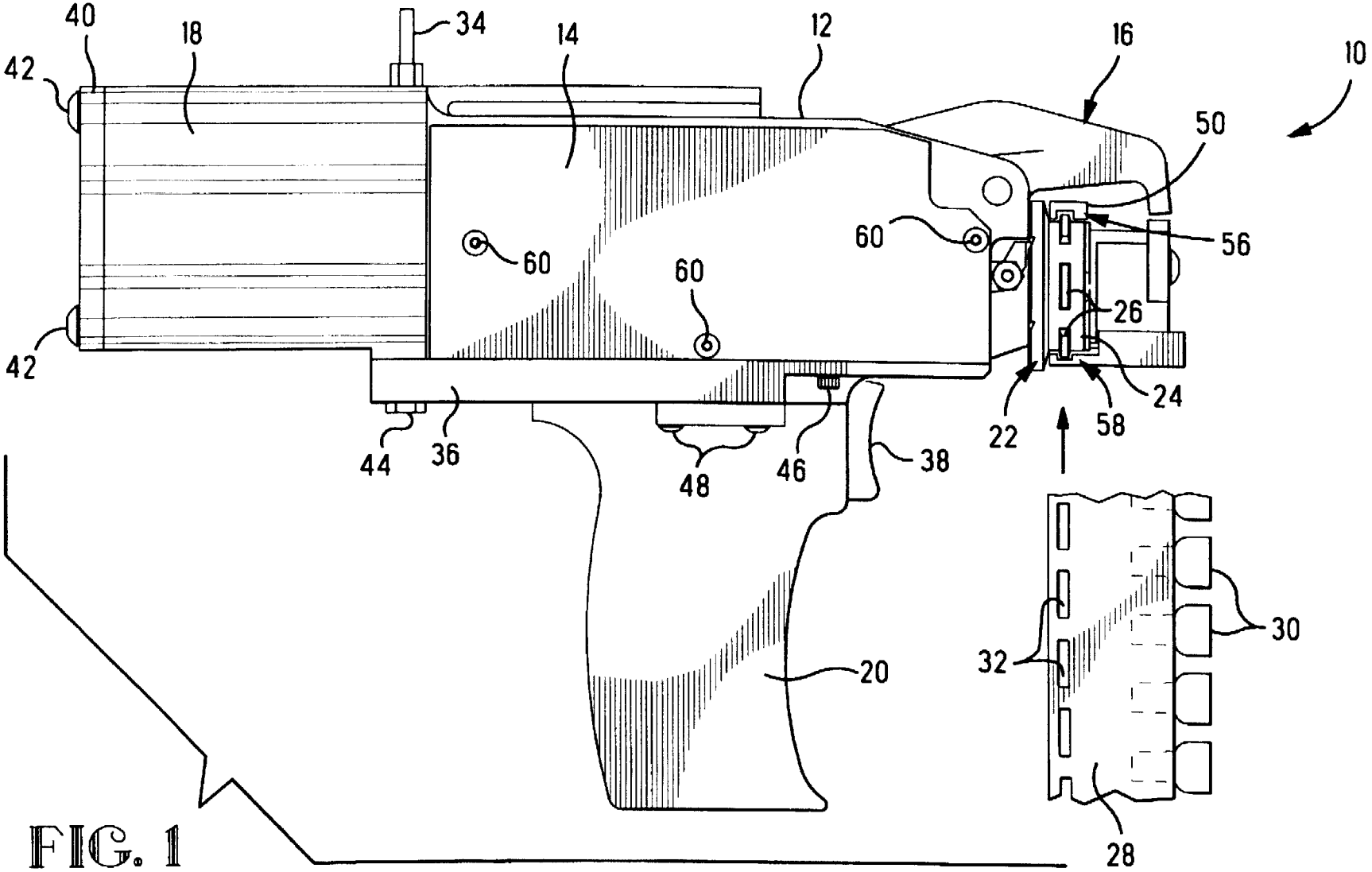
FIG. 1 is a side view of a powered hand tool incorporating the teachings of the present invention.
Figure 2:
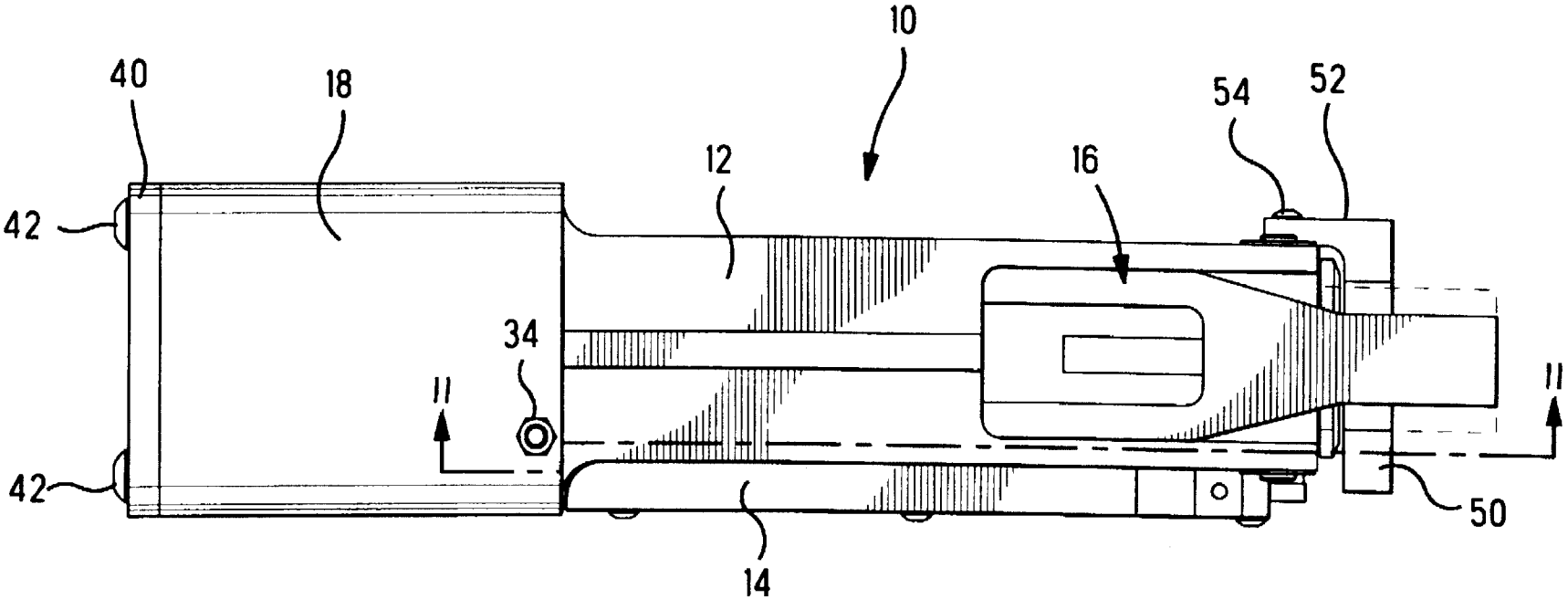
FIG. 2 is a top view of the tool shown in FIG. 1.
Figure 3:
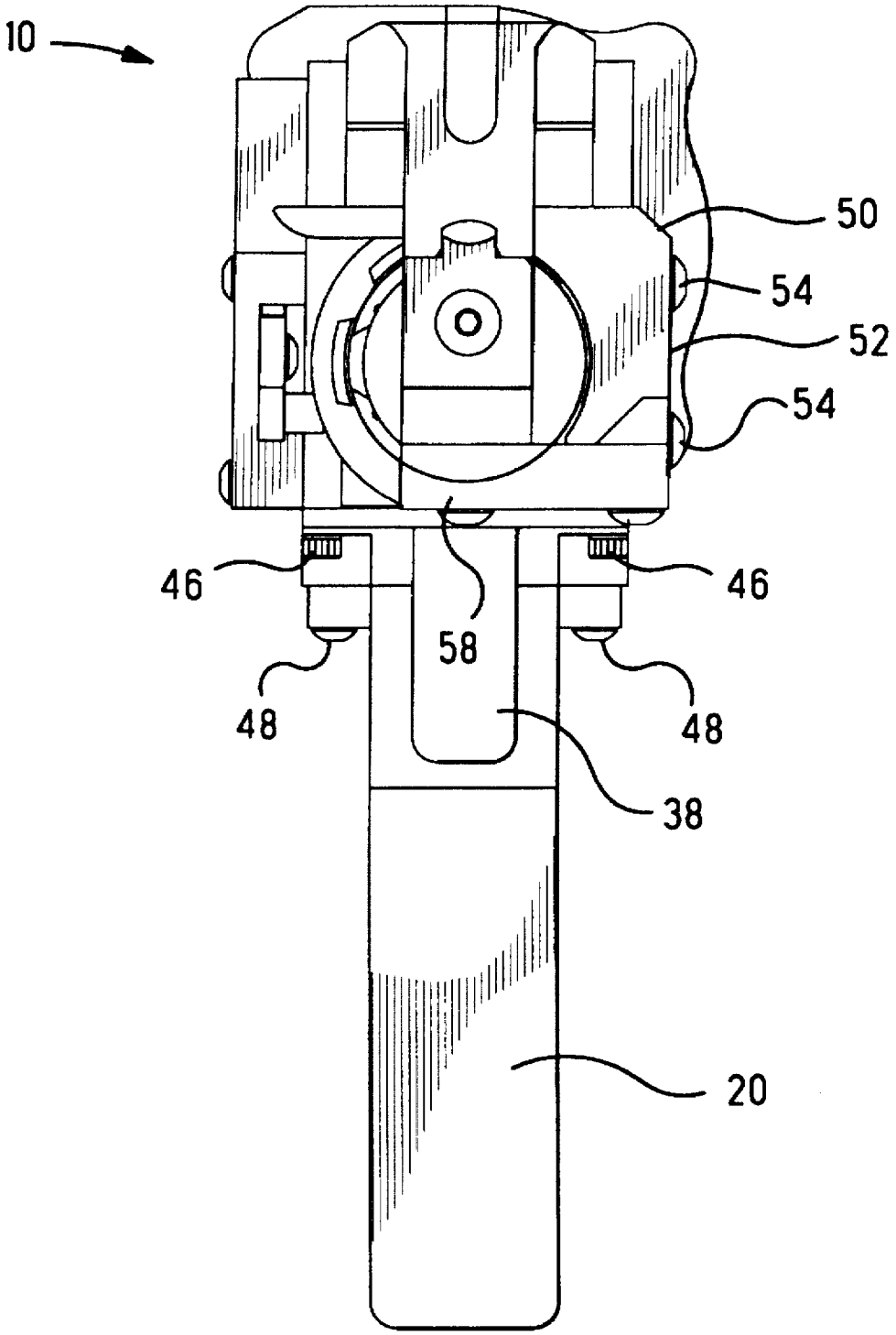
FIG. 3 is a front view of the tool shown in FIG. 1.

There is shown in FIGS. 1, 2, and 3 a powered hand tool 10 for crimping terminals onto a conductor. The tool 10 includes a frame 12, an aluminum side cover 14, a crimping mechanism 16, an air cylinder 18 for actuating the feed mechanism, and a plastic handle 20 for holding and operating the tool. The tool 10 has a feed mechanism 22 including a rotating feed drum 24 having teeth 26 spaced about the periphery of the drum that engage and feed a tape 28 with terminals 30 attached thereto. The tape 28 includes spaced openings 32 along one edge thereof that are engaged by the teeth 26 for feeding and accurately positioning each terminal 30 in turn for crimping. A fitting 34 is provided at the top of the air cylinder for receiving an outside source of compressed air which is routed through the walls of the cylinder into a plastic manifold 36 and to a control valve 37, shown in FIG. 9, that is operated by a trigger 38, in the usual manner. The air cylinder 18 is made integral to the frame 12, and includes an end cap 40 that is secured in place by means of four bolts 42 which are threaded into holes in the walls of the cylinder. The integral cylinder and frame and the end cap are made of aluminum to limit the overall weight of the tool. While, in the present example, the air cylinder is integral to the frame, it may be a separate part which is bolted to the frame. The manifold is attached to the frame and cylinder by means of two screws 44 and two screws 46, while the handle is attached to the manifold 36 by means of four screws 48. A tape guide 50 is arranged in guiding relationship around one half of the feed drum, as best seen in FIG. 3. The tape guide holds the tape 28 in engagement with the teeth 36 of the drum during operation of the tool 10. The tape guide 50 includes a mounting flange 52 extending therefrom that is attached to the frame by means of two screws 54. The feed drum 24 turns clockwise, as viewed in FIG. 3, therefore, the tape 28 enters the feed mechanism at 56 and exits at 58, as best seen in FIG. 1. The cover 14 is attached to the side of the frame 12 by means of three screws 60, and houses the drive linkage for the feed mechanism 22, as will be explained below.

Figure 6:
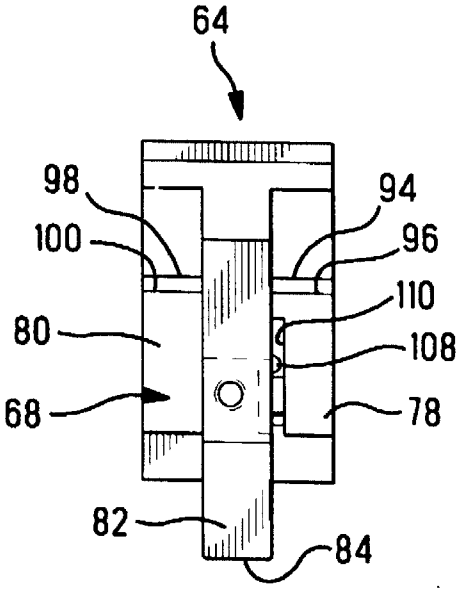
FIGS. 4, 5, 6, and 7 are right side, top, front, and left side views, respectively, of the cam.
Figure 5:
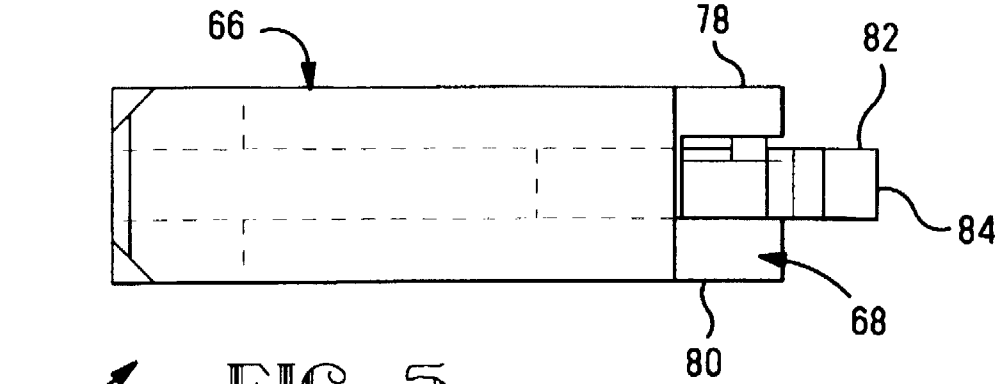
Figure 4:
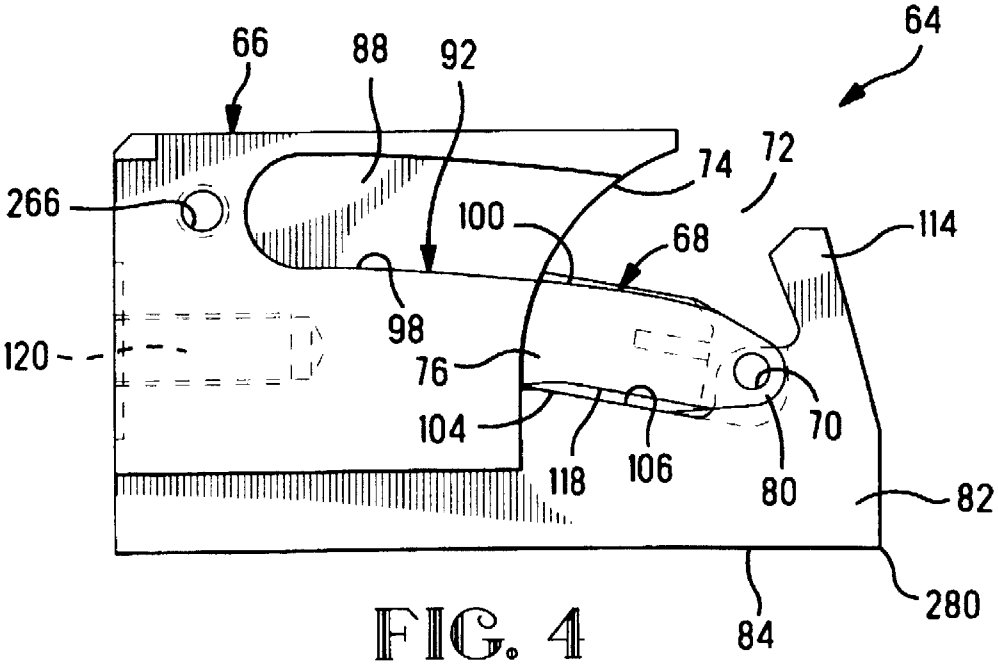
Figure 7:
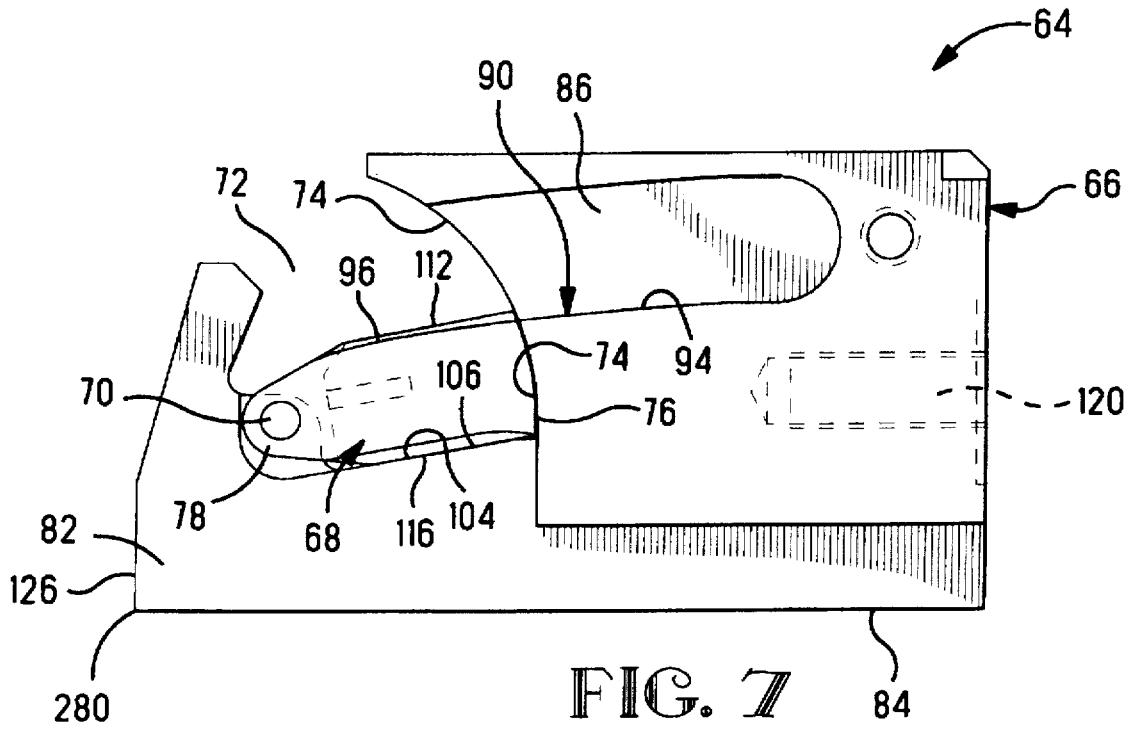
Figure 8:
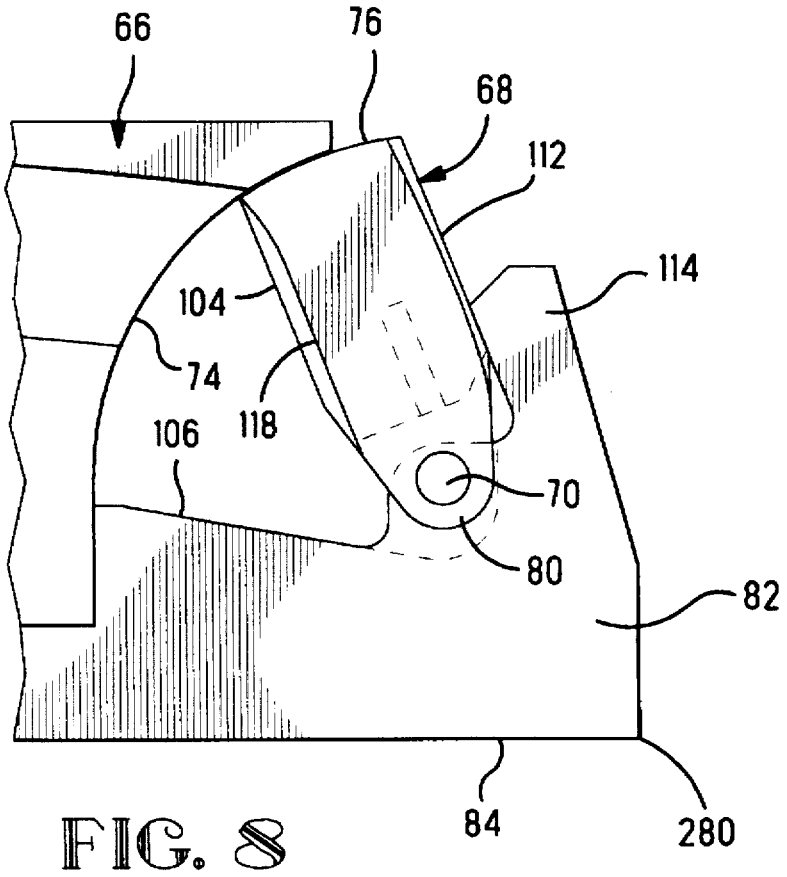
FIG. 8 is a view of a portion of the view shown in FIG. 4 with the gate in its open position.

A steel cam 64 is central to the crimping mechanism 16 and is shown in FIGS. 4 through 8. The cam 64 includes a main member 66 and a gate member 68 that is pivotally attached to the main member by means of a pin 70. An opening 72 is formed in the main body having a radiused surface 74, the center of curvature of the surface 74 being coincident with the center of the pin 70. The gate member 68 is disposed within the opening 72, as shown in FIGS. 4 through 8, and includes a radiused surface 76 that closely mates with the radiused surface 74 with very little clearance. The gate member 68 includes two spaced apart legs 78 and 80 that straddle a narrow portion 82 of the main member 66, as best seen in FIGS. 5 and 6. The narrow portion 82 includes a flat bearing surface 84 that extends the entire length of the main member 66, for a purpose that will be explained. The main member 66 includes a right recess 86 formed in the right side thereof and a left recess 88 formed in the left side thereof. The right and left recesses 86 and 88, together with the gate member 68 form right and left camming surfaces 90 and 92, respectively. The right camming surface 90 includes a first portion 94 that is formed by the recess 86 and a second portion 96 that is formed by an upwardly facing surface of the gate member 68, as shown in FIG. 7. Similarly, the left camming surface 92 includes a first portion 98 that is formed by the recess 88 and a second portion 100 that is formed by an upwardly facing surface of the gate member 68, as shown in FIG. 4. The gate member 68 includes an abutting surface 104 that engages a stop surface 106 on an edge of the narrow portion 82 when the gate is in its closed position, shown in FIGS. 4 and 7. When the gate is in its closed position the first and second portions 94 and 96 of the camming surface 90 are in mutual alignment and contiguous so that they form a substantially smooth uninterrupted surface. It is important that the camming surface 90 be smooth and uninterrupted without discontinuities that could cause the follower to damage the camming surface. Similarly, the first and second portion 98 and 100 of the camming surface 92 are in mutual alignment and contiguous so that they form a substantially smooth uninterrupted surface. The right and left camming surfaces 90 and 92 are substantially identical in shape and size and are oppositely positioned in the main member 66. A torsion spring 108 is disposed about the pin 70 in a small recess 110 formed in the inside of the leg 78 and is arranged to urge the gate member 68 to pivot about the pin 70 to its open position, shown in FIG. 8. The gate member 68 includes an upper abutting surface 112 that abuttingly engages a stop member 114 formed in the narrow portion 82, the torsion spring urging the gate member against this stop member. The gate member includes a pair of rear or opposite camming surfaces 116 and 118 that are opposite respective second portions 96 and 100. As will be explained, these rear camming surfaces are arranged to open the crimping jaws after a crimping operation is completed. The cam 64 includes a threaded hole 120 for receiving a threaded end of a bolt 122 that extends through a piston rod 124 of the cylinder 18 and attaches it tightly to the cam 64, as shown in FIG. 11.

Figure 9:
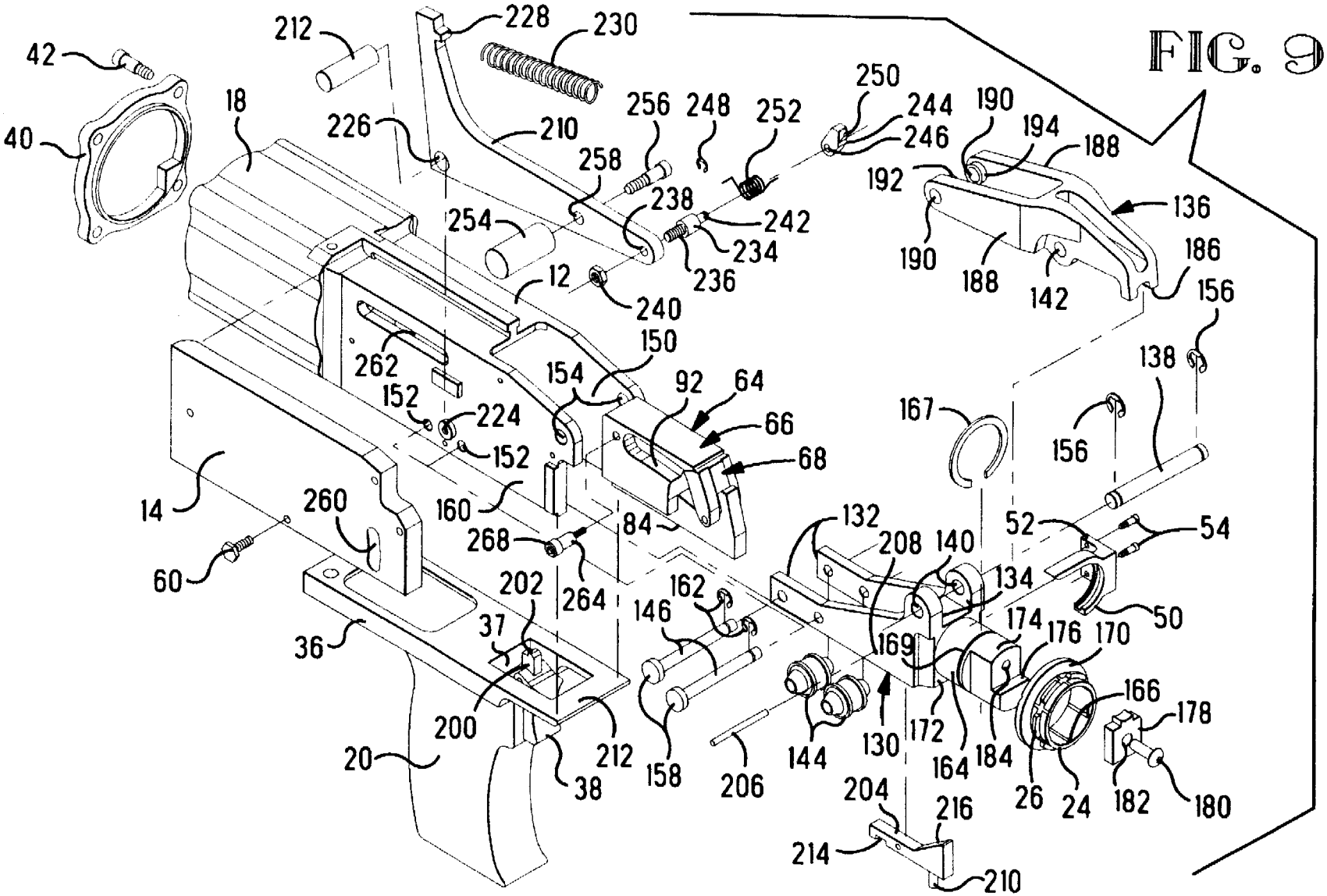
FIG. 9 is an exploded parts view of the tool shown in FIG. 1.
Figure 11:
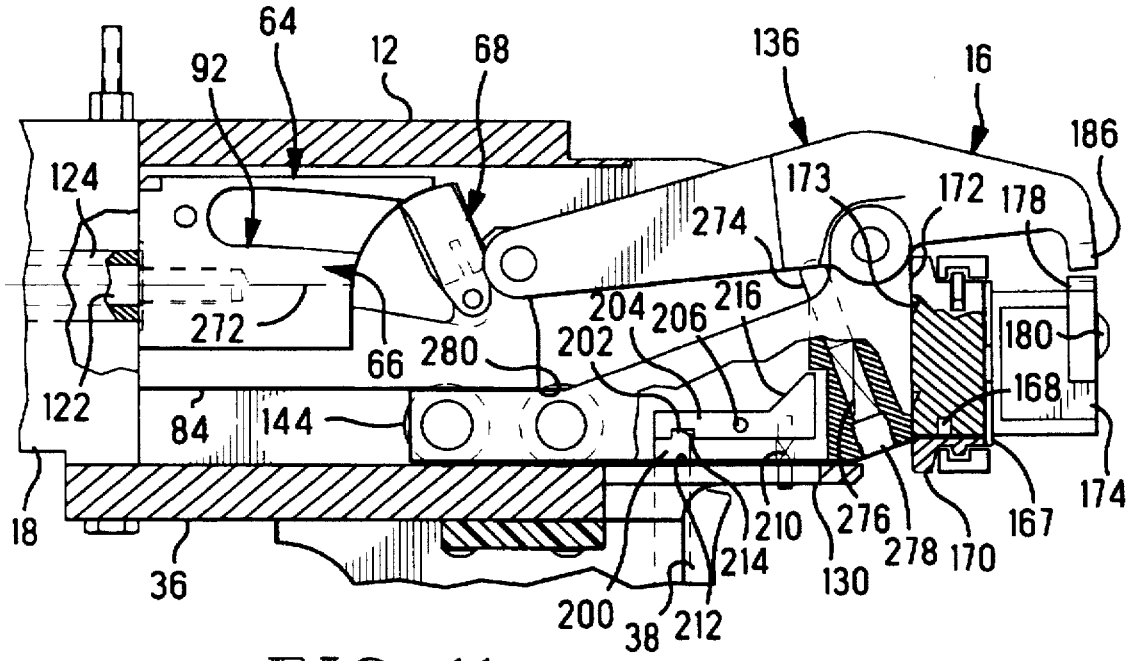
FIG. 11 is a cross-sectional view of a portion of the tool taken along the lines 10—10 in FIG. 2.

As shown in FIGS. 9 and 11, the crimping mechanism 16 includes a fixed member 130 having a pair of support arms 132 extending outwardly therefrom and a pair of attachment lugs 134 that extend upwardly therefrom. An indentor member 136 is pivotally attached to the fixed member 130 by means of a pin 138 that extends through holes 140 in the attachment lugs 134 and a hole 142 in the indentor member. A pair of rollers 144 are journaled for rotation between the two support arms by means of two pins 146 that extend through holes 148 that are formed through both support arms 132, the two support arms straddling the two rollers. Since the fixed member 130, the indentor 136, and the rollers 144 are load bearing components, they are made of steel. The crimping mechanism 16 is partially within a cavity 150 in the frame 12. Two holes 152 are formed completely through the frame and are sized to closely receive the pins 146 and another hole 154 is formed through the frame and is sized to closely receive the pin 138. When the crimping mechanism is in place within the cavity 150, the pin 138 extends completely through the assembly and is held in place by two retaining rings 156, E-rings in the present example, that fit into grooves in the ends of the pin. Each of the two pins 146 has a head 158 that is against the outer wall 160 of the frame 12 while the pins extend completely through the assembly and are held in place by means of two retaining rings 162 that fit into grooves in the pins. The fixed member 130 includes a cylindrically shaped feed drum support 164 for receiving the feed drum 24 and is sized so that the feed drum is free to rotate thereon. The internal bore of the feed drum includes a series of spaced detent grooves 166, shown in FIG. 9, which engage a ball detent 168 that is threaded into a hole in the feed drum support 164, as shown in FIG. 11. The grooves 166 are spaced to conform to the spacing of the terminals 30 on the tape 28 so that as the tape is advanced by the feed mechanism 22 the ball detent 168 will engage a groove 166 every time a terminal 30 is in crimping position. As described above, the tape guide 50 is arranged in guiding relationship around one half of the feed drum, as best seen in FIG. 3. The tape guide holds the tape 28 in engagement with the teeth 36 of the drum during operation of the tool 10. The tape guide 50 is attached to the side of the frame 12 by means of the two screws 54 which extend through the mounting flange 52 and into threaded holes in the frame. The feed drum 26 is positioned on the feed drum support 164 with a flange 170 against a face 172 of the fixed member 130. A retaining ring 167 is disposed in a groove 169 formed in the feed drum support thereby retaining the feed drum in place, as best seen in FIGS. 9 and 11. The surface of the flange 170 that opposes the face 172 includes a series of depressions 173, as best seen in FIG. 11, one depression for each detent groove 166. The depressions 173 are engaged by a feed dog to advance the tape 28, as will be explained in more detail below. A crimping die support 174 has an abutting shoulder 176 for receiving a crimping die 178. The crimping die is secured in place by means of a screw 180 which extends through a hole 182 in the die and into a threaded hole 184 in the die support 174, as shown in FIGS. 9 and 11. The indentor member 136 includes an indentor 186 at one end thereof that matingly engages the crimping die 178 for performing the crimping operation on the terminal 30. The other end includes two spaced apart arms 188 which straddle the cam 64. Each arm has a pin 190 pressed into a hole in the end thereof so that the two pins 190 are mutually opposing and extend into the space between the two arms. A pair of rollers 192 and 194 are journaled, one on each pin, so that the rollers are free to rotate. The two rollers 192 and 194 are cam followers in following engagement with the camming surfaces 90 and 92, respectively, as will be explained in more detail below.

As set forth above, the trigger 38 controls the operation of the control valve 37 and, once actuated, is latched in its actuated position until the operating cycle is complete, and then released to its initial position where it may be actuated again for the next cycle. The latch mechanism includes a latch member 200 that is secured to the trigger 38 and has a finger 202 that projects upwardly between the two support arms 132, as best seen in FIG. 11. A catch 204 is pivotally attached to the fixed member 130 by means of a pin 206 which extends through holes 208 in the arms 132. A compression spring 210 projects from a hole in the catch 204 and engages a surface 212 of the manifold 36 thereby urging the catch to pivot counterclockwise about the pin 206. The catch includes a notch 214 that latches onto the finger 202 to hold the trigger in its actuated position, as shown in FIG. 11. An inclined surface 216 is formed on the catch facing in the direction of the cam 64 for a purpose that will be explained.

Figure 10:
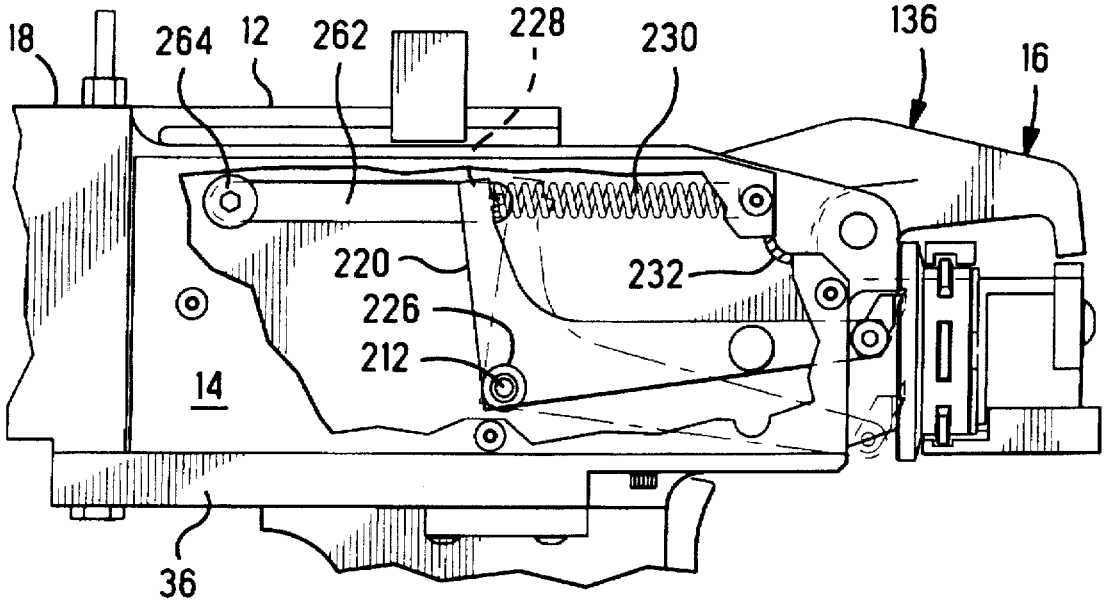
FIG. 10 is a partial side view of the tool showing a portion of the cover cut away.

The feed linkage that operates the feed mechanism 22, as best seen in FIGS. 9 and 10, includes an L-shaped feed arm 210 that is pivotally attached to the frame 12 by means of a pin 212 that is pressed into a hole 224 in a boss on the outer wall 160 of the frame. A bushing 226 is pressed into a hole in the feed arm 210 and is a slip fit with the pin 212. A short projection 228 is arranged on one end of the feed arm for retaining one end of a compression spring 230. The other end of the compression spring engages an inner wall 232 of the cover 14, as best seen in FIG. 10, thereby urging the feed arm 210 to pivot counterclockwise about the pin 212. A stud 234 has a threaded portion 236 that extends through a hole 238 in the other end of the feed arm and is secured thereto by a nut 240. A pin portion 242 extends outwardly from the stud for receiving a feed dog 244. The feed dog has a hole 246 that is a slip fit with the pin portion 242. The feed dog 244 is held on the pin portion by means of a retaining ring 248 which engages a groove in the end of the pin portion. The free end of the feed dog has a feed tooth 250 that is sized to engage one of the depressions 173. The feed dog is biased to pivot clockwise, as viewed in FIG. 10, about the pin portion 242 by means of a torsion spring 252 that is fixed to the stud 234. An elongated opening 262 is formed in the outer wall 160 of the frame 12. A shoulder screw 264 is tightly threaded into a hole 266 in the side of the cam 64, as best seen in FIG. 9, and extends through the elongated opening 262 so that the head 268 of the screw is in a common plane with the feed arm 210. Therefore, when the cam is moved to the right by actuation of the cylinder 18, as viewed in FIG. 10, the head 268 will engage and pivot the feed arm 210 clockwise against the urging of the spring 230.

Figure 12:
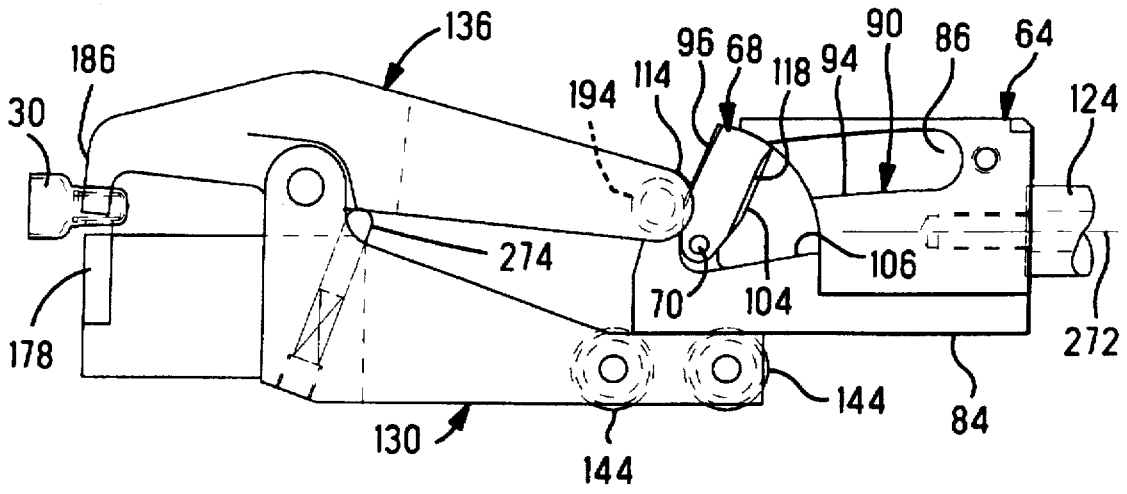
FIGS. 12 through 15 are schematic representations of a portion of the crimping mechanism showing the cam in various operating positions.
Figure 13:
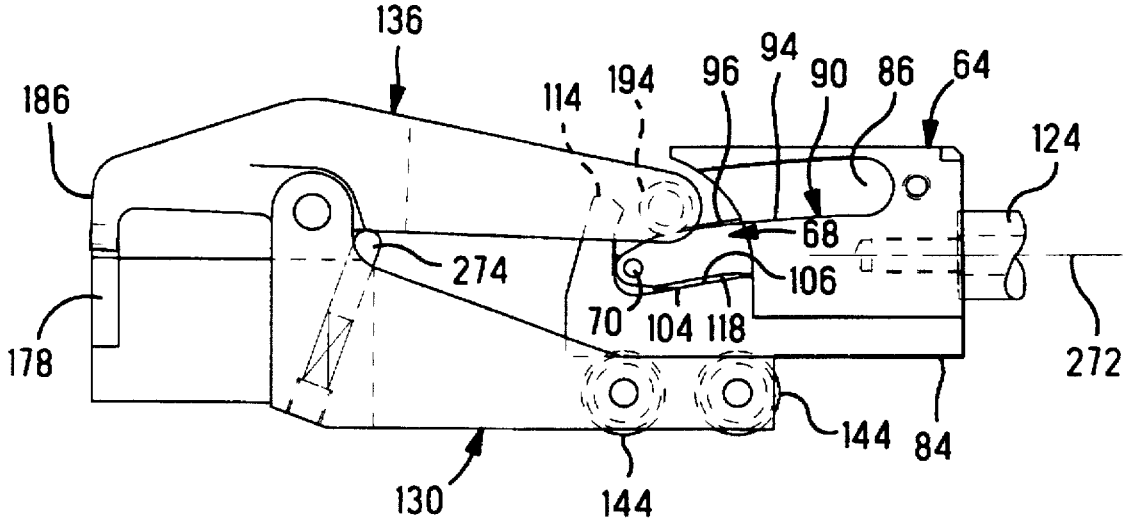
Figure 14:
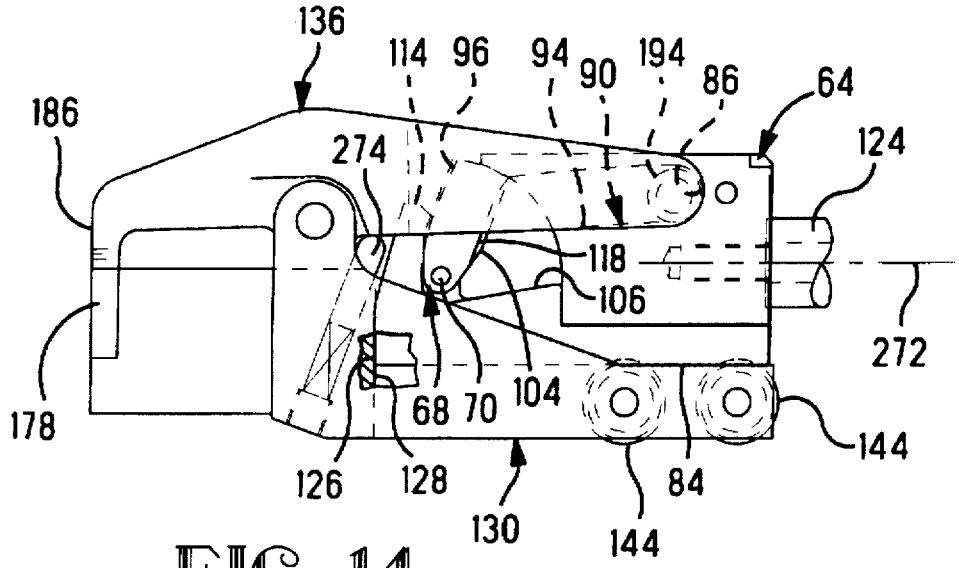
Figure 15:
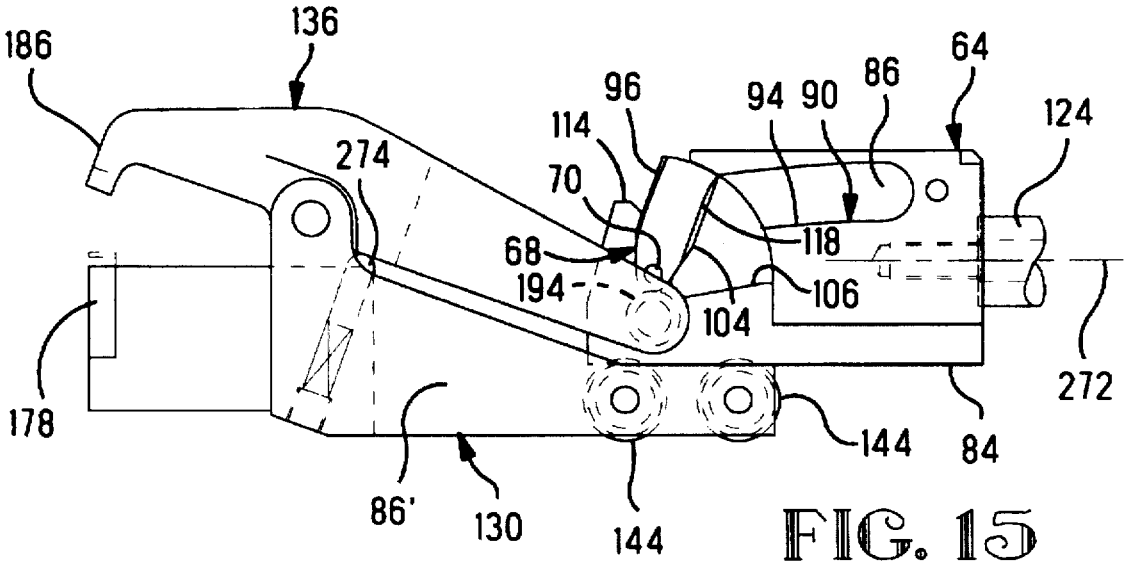

In operation, as shown in FIGS. 10 through 15, the cam 64 has a flat bearing surface 84 that rides on the two rollers 144. The cylinder piston rod 124 is arranged to move the cam 64 along a longitudinal axis 272 that is substantially parallel to the bearing surface 84. Before actuation of the cylinder 18 the cam 64 is in its start position as shown in FIGS. 11 and 12. Additionally, the indentor member 136 is urged to pivot clockwise by a round nose pin 274 that is a slip fit within a hole formed in the fixed member 130. A compression spring 276, backed up by a set screw 278 that is threaded into the hole, urges the pin 274 into pushing engagement with the indentor member 136 so that the indentor 186 lightly engages the terminal 30, as shown in FIG. 12. As the trigger 38 is pulled it is latched in place by the catch 204, as described above, and the air cylinder pressurized so that the piston rod 124 begins to advance the cam 64 along the longitudinal axis 272 toward the left as viewed in FIG. 12. As motion continues, the followers 192 and 194 engage the gate member 68, causing it to pivot clockwise until it is in its closed position. The followers then ride up onto the second portions 96, 100 of the camming surfaces 90 and 92, respectively, as shown in FIG. 13. As the followers track along the second portions 96 and 100 of their respective camming surfaces, the indentor member 136 pivots counterclockwise causing the indentor 186 to begin crimping the terminal 30 against the die 178. As the piston rod 124 continues to move the cam 64 toward the left, the followers engage and track along the first portions 94 and 98 of their respective camming surfaces and further crimp the terminal 30 until the end 126 of the cam engages a limiting surface 128 on the fixed member 130, as shown in FIG. 14. At this point the terminal is fully crimped. Note that as the followers transition from the second portions to the first portions of the camming surfaces 92 and 92, the torsion spring 108 urges the gate member 68 to pivot counterclockwise to its open position, as shown in FIG. 14. At this point the crimping die 178 and the indentor 186 are at their closest engagement. Concurrently with the followers 192 and 194 tracking along the first portion 94 and 98, the shoulder screw 264, which is carried by the cam 64, engages the feed arm 220 causing it to pivot clockwise against the urging of the spring 230, as viewed in FIG. 10, to the position shown in phantom lines, so that the feed dog 244 engages the next depression 173 in the feed drum 26. Additionally, concurrently with the last part of the piston rod stroke, a forward corner 280 of the cam 64, shown in FIG. 11, engages the inclined surface 216 of the catch 204 causing it to pivot clockwise, as viewed in FIG. 11, thereby releasing the latch member 200 so that the trigger 38 can return to its unactuated position. At this point the piston rod 124 is at the end of its stroke, the followers 192 and 194 are in the position shown in FIG. 14, and the gate 68 has pivoted to its open position blocking the second portions 96 and 100 of the camming surfaces 90 and 92 so that the followers 192 and 194 are prevented from moving back onto the second portion. The air cylinder 18 is then pressurized to return the piston rod to its original position thereby moving the cam 64 to the right, as viewed in FIG. 14. This causes the followers to follow along their respective first portions 92 and 94 of their respective camming surfaces until they disengage the first portions and then engage the rear camming surfaces 116 and 118, respectively. The followers 192 and 194 then track downwardly along the camming surfaces 116 and 118 until they reach the point shown in FIG. 15. At this point the indentor 186 and the crimping die 178 are spaced apart a maximum distance. As movement of the piston rod continues toward the right, as viewed in FIG. 15, the followers 192 and 194 disengage the gate member 68. The detent member 136 is then caused to pivot counterclockwise by the spring loaded pin 274 so that the followers move up to their start position shown in FIG. 12. During the return stroke of the cam 64, while the followers are approximately in the position shown in FIG. 15, the shoulder screw 264 disengages the feed arm 220 allowing it to pivot counterclockwise, as viewed in FIG. 10, under the urging of the spring 230. As this occurs the feed dog 244 rotates the feed drum clockwise, as viewed in FIG. 3, one position so that the next terminal 30 is positioned between the indentor 186 and the crimping die 178, ready for the next crimping cycle, as shown in FIG. 12.

An important advantage of the present invention is that the total stroke of the cylinder is relatively short while still providing sufficient opening of the crimping dies to allow lateral feeding of terminals arranged on a strip of tape. This relatively short stroke is directly related to the cam having a gate as an integral part of the camming surface which permits the followers to completely disengage from the camming surfaces after tracking only part way during the return stroke. The short stroke translates into a lighter, more compact, and well balanced hand tool. Additionally, the structure of the present cam and gate generate sufficiently high forces to effect a high quality crimp.

I claim:

1. In a powered hand tool for crimping a terminal onto an electrical conductor, said tool having a frame, a linear actuator having a piston rod arranged to move in a first direction and a second opposite direction along a longitudinal axis, a terminal crimping mechanism comprising:

(a) a fixed crimping jaw attached to said frame:

(b) a cam attached to and carried by said piston rod, said cam having a camming surface including a first portion and a second portion movable with respect to said first portion;

(c) an indent member pivotally attached to said frame and having a cam follower at one end thereof adapted for following engagement with said camming surface and a movable crimping jaw attached to another end thereof and arranged so that when said indent member is pivoted in one direction said movable crimping jaw moves toward said fixed crimping jaw, wherein said first and second portions of said camming surface are arranged so that when a terminal is in crimping position between said crimping jaws and said follower is in a start position, as said piston rod is moved in said first direction said follower engages and follows along said second portion causing said indent member to pivot in said one direction into partial crimping engagement with said terminal and then, while said piston rod continues to move in said first direction said follower engages and follows along said first portion causing said indent member to pivot further in said one direction into full crimping engagement with said terminal and then, as said piston rod is moved in said second direction said follower retracts along said first portion and is blocked from engagement with said second portion while said piston rod continues to move in said second direction, wherein said indent member is caused to pivot in an opposite direction thereby moving said jaws apart.

2. The tool according to claim 1 wherein said cam includes a main member and a gate member, said second portion of said camming surface being a surface of said gate member, said gate member arranged to direct said follower away from said second portion during said movement of said piston rod in said second direction.

3. The tool according to claim 2 wherein said gate member is an elongated plate having one end pivotally attached to said main member for pivoting between a closed position where said second portion of said camming surface is in alignment with and contiguous to said first portion thereof so that said camming surface is smooth and uninterrupted, and an open position where said second portion is out of alignment with and away from said first portion.

4. The tool according to claim 3 wherein said main member includes a backup surface and said gate member includes an abutting surface that is in pressing engagement therewith when said gate member is in said closed position.

5. The tool according to claim 4 wherein said gate member includes a rear camming surface arranged so that when said piston rod is moving in said second direction, said follower follows along said first portion and then engages said rear camming surface, thereby being blocked from engagement with said second portion, and is directed substantially lateral to said second direction so that said indent member further pivots in said opposite direction thereby further moving said jaws apart.

6. The tool according to claim 5 wherein said gate member is arranged so that as said follower moves in said lateral direction and said piston rod continues to move in said second direction, said follower moves along said rear camming surface then around said pivotal attachment of said gate member and then moves out of engagement with said gate member to said starting position.

7. The tool according to claim 6 wherein said indent member includes a resilient member arranged to bias said indent member into said start position when said follower moves out of said engagement with said gate member.

8. The tool according to claim 3 wherein said tool includes a resilient member coupled to said main member and arranged to urge said gate member into said open position so that when said follower moves from said starting position into engagement with said gate member, said gate member pivots against the urging of said resilient member into said closed position where said abutting surface is in pressing engagement with said backup surface.

9. The tool according to claim 1 wherein said cam comprises an elongated body having a cutout therein and a pair of recesses formed in opposite sides thereof, a surface of each said recess being said first portion of said camming surface, and a gate member disposed within said cutout and being pivotally attached to said elongated body, said gate member having a pair of adjacent surfaces that are said second portion of said camming surface, one of said pair of adjacent surfaces being in alignment with and contiguous to said surface of one of said recesses and the other of said pair of adjacent surfaces being in alignment with and contiguous to said surface of the other of said recesses.

10. A terminal crimping mechanism in a powered hand tool for crimping a terminal onto an electrical conductor, comprising:

(a) a fixed crimping jaw attached to said tool:

(b) a cam coupled to said tool and movable along an axis thereof in first and second directions, said cam having a camming surface including a first portion and a second portion aligned therewith, said second portion movable out of said alignment with said first portion;

(c) an indent member pivotally attached to said tool and having a cam follower at one end thereof adapted for following engagement with said camming surface and a movable crimping jaw attached to another end thereof and arranged so that when said indent member is pivoted in one direction said movable crimping jaw moves toward said fixed crimping jaw, wherein said first and second portions of said camming surface are arranged so that when a terminal is in crimping position between said crimping jaws and said follower is in a start position, as said cam is moved in said first direction said follower engages and follows along said second portion causing said indent member to pivot in said one direction into partial crimping engagement with said terminal and then, while said cam continues to move in said first direction said follower engages and follows along said first portion causing said indent member to pivot further in said one direction into full crimping engagement with said terminal and then, as said cam is moved in said second direction said follower retracts along said first portion and is blocked from engagement with said second portion while said cam continues to move in said second direction, wherein said indent member is caused to pivot in an opposite direction thereby moving said jaws apart.

11. The terminal crimping mechanism according to claim 10 wherein said cam includes a main member and a gate member, said second portion of said camming surface being a surface of said gate member, said gate member arranged to direct said follower away from said second portion during said movement of said cam in said second direction.

12. The terminal crimping mechanism according to claim 11 wherein said gate member is an elongated plate having one end pivotally attached to said main member for pivoting between a closed position where said second portion of said camming surface is in alignment with and contiguous to said first portion thereof so that said camming surface is smooth and uninterrupted, and an open position where said second portion is out of alignment with and away from said first portion.

13. The terminal crimping mechanism according to claim 12 wherein said main member includes a backup surface and said gate member includes an abutting surface that is in pressing engagement therewith when said gate member is in said closed position.

14. The terminal crimping mechanism according to claim 13 wherein said gate member includes a rear camming surface arranged so that when said cam is moving in said second direction, said follower follows along said first portion and then engages said rear camming surface, thereby being blocked from engagement with said second portion, and is directed substantially lateral to said second direction so that said indent member further pivots in said opposite direction thereby further moving said jaws apart.

15. The terminal crimping mechanism according to claim 14 wherein said gate member is arranged so that as said follower moves in said lateral direction and said cam continues to move in said second direction, said follower moves along said rear camming surface then around said pivotal attachment of said gate member and then moves out of engagement with said gate member to said starting position.

16. The terminal crimping mechanism according to claim 15 wherein said indent member includes a resilient member arranged to bias said indent member into said start position when said follower moves out of said engagement with said gate member.

17. The terminal crimping mechanism according to claim 12 wherein said tool includes a resilient member coupled to said main member and arranged to urge said gate member into said open position so that when said follower moves from said starting position into engagement with said gate member, said gate member pivots against the urging of said resilient member into said closed position where said abutting surface is in pressing engagement with said backup surface.

* * * * *